US007856301B2

(12) United States Patent
Sjögren et al.

(10) Patent No.: US 7,856,301 B2
(45) Date of Patent: Dec. 21, 2010

(54) DEVICE AND METHOD FOR CONTROLLING A MACHINE

(75) Inventors: Joakim Sjögren, Köping (SE); Bo Vigholm, Stora Sundby (SE); Nils-Erik Bånkestad, Eskilstuna (SE); Sven-Alie Carlsson, Eskilstuna (SE); Gunnar Löwestrand, Malmköping (SE)

(73) Assignee: Volvo Construction Equipment AB, Eskilstuna (SE)

( * ) Notice: Subject to any disclaimer, the term of this patent is extended or adjusted under 35 U.S.C. 154(b) by 1267 days.

(21) Appl. No.: 10/904,102

(22) Filed: Oct. 22, 2004

(65) Prior Publication Data

US 2008/0040006 A1 Feb. 14, 2008

Related U.S. Application Data

(63) Continuation-in-part of application No. PCT/SE03/00649, filed on Apr. 17, 2003.

(30) Foreign Application Priority Data

Apr. 22, 2002 (SE) ..... 0201196-3

(51) Int. Cl.

| | |
|---|---|
| ***G06F 7/70*** | (2006.01) |
| ***G06F 19/00*** | (2006.01) |
| ***G06G 7/00*** | (2006.01) |
| ***G06G 7/76*** | (2006.01) |
| *G06F 7/00* | (2006.01) |
| *G06F 17/00* | (2006.01) |

(52) U.S. Cl. ..... 701/50; 701/51; 701/56

(58) Field of Classification Search ..... 172/35; 92/12.1

See application file for complete search history.

(56) References Cited

U.S. PATENT DOCUMENTS

| | | | | |
|---|---|---|---|---|
| 2,848,902 | A * | 8/1958 | Hale | 74/502 |
| 3,633,679 | A * | 1/1972 | Dahlberg et al. | 172/123 |
| 4,314,619 | A * | 2/1982 | Tsuji | 180/327 |
| 4,548,094 | A * | 10/1985 | Huitema et al. | 74/526 |
| 4,598,545 | A * | 7/1986 | Harada | 60/435 |
| 4,610,335 | A * | 9/1986 | Miyazawa et al. | 192/3.62 |
| 4,727,710 | A * | 3/1988 | Kuhn | 56/10.2 G |
| 4,885,690 | A * | 12/1989 | Schimmel et al. | 701/54 |
| 5,034,892 | A * | 7/1991 | Saotome | 701/50 |
| 5,116,187 | A * | 5/1992 | Fukuda et al. | 414/699 |
| 5,211,258 | A * | 5/1993 | Wibom | 180/275 |

(Continued)

FOREIGN PATENT DOCUMENTS

| | | | |
|---|---|---|---|
| EP | 0715102 | A2 | 6/1996 |
| EP | 0860557 | A1 | 8/1998 |
| EP | 1193582 | A1 | 4/2002 |
| WO | 03/089723 | A1 | 10/2003 |

OTHER PUBLICATIONS

International Search Report dated Jun. 19, 2003 from the International Application PCT/SE03/00649.

*Primary Examiner*—Khoi Tran
*Assistant Examiner*—Nicholas Kiswanto
(74) *Attorney, Agent, or Firm*—Novak Druce + Quigg, LLP

(57) ABSTRACT

Method and device for controlling a machine which is intended to be operated in several different operating states, the machine being intended to utilize different types of equipment in at least two of these operating states for different activities. The device includes a means (1) which is intended to be actuated and which can be set in a number of different positions (2-6), and each of these positions corresponds to one of the operating states.

11 Claims, 7 Drawing Sheets

U.S. PATENT DOCUMENTS 5,346,035 A * 9/1994 Ueda et al. ..... 180/329
5,457,960 A * 10/1995 Morishita ..... 91/361
5,774,820 A 6/1998 Linden et al.
5,884,528 A * 3/1999 Ludanek et al. ..... 74/473.3
5,929,389 A * 7/1999 Keuper ..... 177/141
6,016,457 A * 1/2000 Toukura et al. ..... 701/70
6,032,751 A * 3/2000 Loichinger et al. ..... 180/6.7
6,064,933 A * 5/2000 Rocke ..... 701/50
6,249,727 B1 * 6/2001 Muller ..... 701/36
6,330,502 B1 * 12/2001 Cetinkunt et al. ..... 701/50
6,336,068 B1 * 1/2002 Lawson et al. ..... 701/50
6,427,107 B1 * 7/2002 Chiu et al. ..... 701/50
6,448,670 B1 * 9/2002 Onodera et al. ..... 307/10.1
6,542,789 B2 * 4/2003 Ufheil ..... 700/275
6,564,661 B2 * 5/2003 DeJonge ..... 74/335
6,654,676 B2 * 11/2003 Nakagawa et al. ..... 701/50
6,661,114 B2 * 12/2003 Syamoto ..... 307/10.1
6,718,245 B2 * 4/2004 Watanabe et al. ..... 701/50
6,851,495 B2 * 2/2005 Sprinkle et al. ..... 180/53.2
6,865,870 B2 * 3/2005 Heisey ..... 56/10.2 G
2001/0032031 A1 10/2001 Ufheil
2002/0065595 A1 * 5/2002 Shin ..... 701/50
2002/0082757 A1 * 6/2002 Behnke ..... 701/50
2002/0138188 A1 * 9/2002 Watanabe et al. ..... 701/50
2002/0193927 A1 * 12/2002 Nakagawa et al. ..... 701/50
2005/0115760 A1 * 6/2005 Sprinkle et al. ..... 180/338

* cited by examiner

DEVICE AND METHOD FOR CONTROLLING A MACHINE

CROSS-REFERENCE TO RELATED APPLICATIONS

The present application is a continuation-in-part patent application of International Application No. PCT/SE03/00649 filed Apr. 17, 2003, which is published in English pursuant to Article 21(2) of the Patent Cooperation Treaty, and which claims priority to Swedish Application No. 0201196-3 filed 22 Apr. 2002. Each of said applications is expressly incorporated herein by reference in its entirety.

FIELD OF THE INVENTION

The present invention relates to a device for controlling a machine in several different operating states, the machine being intended to utilize different types of equipment (work implements and/or work tools) in at least two of these operating states for different activities. Such a device is found in a construction machine in the form of, for example, a wheel loader; therefore, the invention is exemplarily described hereinbelow as being applied in a wheel loader. It should be appreciated that this particular configuration is to be regarded only as an example of a preferred application; and further, the invention also relates to a corresponding control method.

BACKGROUND OF THE INVENTION

The term work vehicle comprises different types of construction machines, such as a wheel loader, a backhoe loader and an excavator. The invention will be described below in a case in which it is applied in a wheel loader. This is to be regarded only as an example of a preferred application.

The wheel loader can be utilized for a number of different areas of activity, such as lifting and transporting stone and gravel, pallets and logs. For some of these activities, use is made of different implements, such as a bucket, a fork and gripping arms. Besides an implement, the equipment also comprises a load-arm unit and one or more working cylinder(s) for operating/moving the implement in question.

When the wheel loader is used for loading material on a loading vehicle such as a dumper or a truck, the implement carrying the material is raised to a high vertical position and the wheel loader is brought nearer to the loading vehicle. Due to the large weight of the material, the movement of the wheel loader is sensitive, which requires great driver skills, and often leads to jerks and swings.

It is known to use different so-called gear shifting modes according to a specific gear shifting strategy in wheel loaders with an automatic gear box. Shifting to a higher gear takes place at different minimum engine speeds in two different gear shifting modes. Further, shifting to a lower gear takes place at different minimum vehicle speed in two different gear shifting modes. The gear shifting modes are selected manually by a driver by operating a handle, a so-called APS-handle.

Further, it is known, for example from EP 0715102 to control gear shifting modes of an automatic vehicle transmission based on parameter signals representing specific operation conditions, such as road conditions. Especially, the parameter signal represents the inclination of the road, on which the vehicle is moving.

WO 03/89723 relates to a device for controlling a work vehicle. The control device comprises actuation means, which is manually operated by the driver, for selecting different operating states. Such operating states may be defined by specific activities where different implements, like a bucket or pallet forks are used. Said actuation means is coupled to a central unit. The central unit is coupled to the hydraulic system for moving the implement and the movement of the implement is controlled depending on the selected operating state. The central unit is also coupled to the engine and/or the transmission for controlling the speed of the engine and/or selecting a gear point for the transmission depending on the selected operating state. The control device also comprises means for detection of the position of the implement. The detection means is also coupled to the central unit and the speed of movement of the implement may be limited depending on the detected position of the implement.

It should be appreciated that the number of functions that are routinely performed by a wheel loader has increased over the years, as have number and complexity of desired different function settings. In the wheel loader cab, there are a number of controls for setting and handling the implements. With the greater number of functions and controls, it has become increasingly difficult for the driver to find/set optimum operational settings for different activities and implements which obtain maximum performance from the machine.

This problem is more marked or pronounced in cases where drivers are changed frequently, and they are relatively inexperienced at operating the wheel loader. In these cases, problems often arise for these drivers to rapidly set the machine in an optimum way for handling.

SUMMARY OF THE INVENTION

One object of the present invention is to provide a device that affords opportunities for more simple, more rapid and/or more reliable handling of a machine which is intended to be operated in several different operating states, and the machine is one which is intended to utilize different types of equipment in at least two of these operating states for different activities. Another object of the invention is to afford opportunities for more effective use of the machine.

These objects are achieved by virtue of the fact that the device comprises (includes, but is not necessarily limited to) a means which is intended to be actuated and which can be set in a number of different positions for selection of one of several operating states for the purpose of controlling specific operating parameters corresponding to the operating state selected. With the aid of the actuation means, it is therefore possible to select an operating state which affords optimum opportunities for handling a specific item of equipment.

According to a preferred embodiment of the invention, the actuation means is adapted for direct (manual) operation by the operator of the machine, and is also arranged in a cab of the machine. This results in simple and convenient handling (manipulation/actuation) for the operator.

According to another preferred embodiment of the invention, each of the positions corresponds to at least one range for the operating state, and the device comprises a number of controls for controlling/adjusting the equipment within the range.

The machine is therefore limited in one or more aspects with respect to the range. The limitation can consist of only an upper limit. In a wheel loader, this can be, for example, a limitation of the maximum speed of movement of the implement or the loading arm unit. By way of example, the controls can consist of a number of electric control levers.

According to one development (version or embodiment) of the preceding embodiment, the device comprises means for detecting the position of the equipment, and different positions correspond to different ranges. In this way, it is possible, for example, to limit the maximum speed of movement of the equipment to a varying extent depending upon the position of the selector/actuator.

According to another preferred embodiment of the invention, the equipment comprises an implement intended to be brought into contact with an object or material to be handled or moved. The equipment also comprises a working cylinder for moving the implement. Here, each of the positions for the actuation means corresponds, for example, to the speed range within which the implement in question can be moved.

The device also preferably comprises a central unit for controlling said equipment, and the central unit is connected to both said actuation means and said equipment (the mechanical portions of the machine).

A further object of the invention is to provide a method which affords opportunities for more simple, rapid and/or reliable handling of a machine which is intended to be operated in several different operating states, and in which the machine is intended to utilize different types of equipment in at least two of these operating states for different activities. Another object is to afford opportunities for more effective use of the machine. These objects are achieved by virtue of the fact that a position of an actuation means is detected and, depending on the position detected, specific operating parameters corresponding to the selected operating state are controlled.

In an alternative embodiment of the presently disclosed inventions, another object is to achieve a method for controlling the movements of a work vehicle that creates softer movements and a more simple operation, especially during loading.

This object is achieved in that a state of said equipment is determined and that at least one operating parameter of a driveline of the vehicle is controlled depending on the determined equipment state. Preferably, the position of the equipment is determined. By determining the vertical position of the equipment and for a high vertical position changing gears in the gear box so that the driver can depress a gas pedal more for a certain vehicle speed/movement, the movements of the work vehicle may be softened and the operation of the vehicle facilitated and made more efficient.

According to one preferred embodiment of this development, the position of the equipment is determined by a lift angle and/or a tilt angle of an implement in the equipment. This may be achieved by sensing the extension of a hydraulic lift and/or tilt cylinder in the equipment and/or by sensing the angular relationship in an articulation point in a load-arm unit.

According to a further preferred embodiment, at least two different equipment position regions are predefined. By dividing the movement pattern of the implement in different regions, the operating parameter of the driveline may be controlled accurately. Especially, at least two different equipment position regions are predefined for each of the lift angle and the tilt angle of the implement. Specific combinations of a lift angle region and a tilt angle region may therefore be used for controlling the operating parameter of the driveline.

Still a further object of the present invention is to achieve a device for controlling the movements of a work vehicle which creates softer movements and a more simple operation, especially during loading. This object is achieved in that the device comprises means for determining a state of said equipment and a control unit for controlling at least one operating parameter of the driveline depending on the determined equipment state.

Other preferred embodiments and advantages of the invention will be appreciated by those persons skilled in these arts based (emerging from) the description, including the associated patent claims.

BRIEF DESCRIPTION OF FIGURES

The invention will be described in greater detail hereinbelow, with reference to the illustrated embodiment shown in the accompanying drawings, and in which.

DETAILED DESCRIPTION OF A PREFERRED EMBODIMENT

Figure 1:
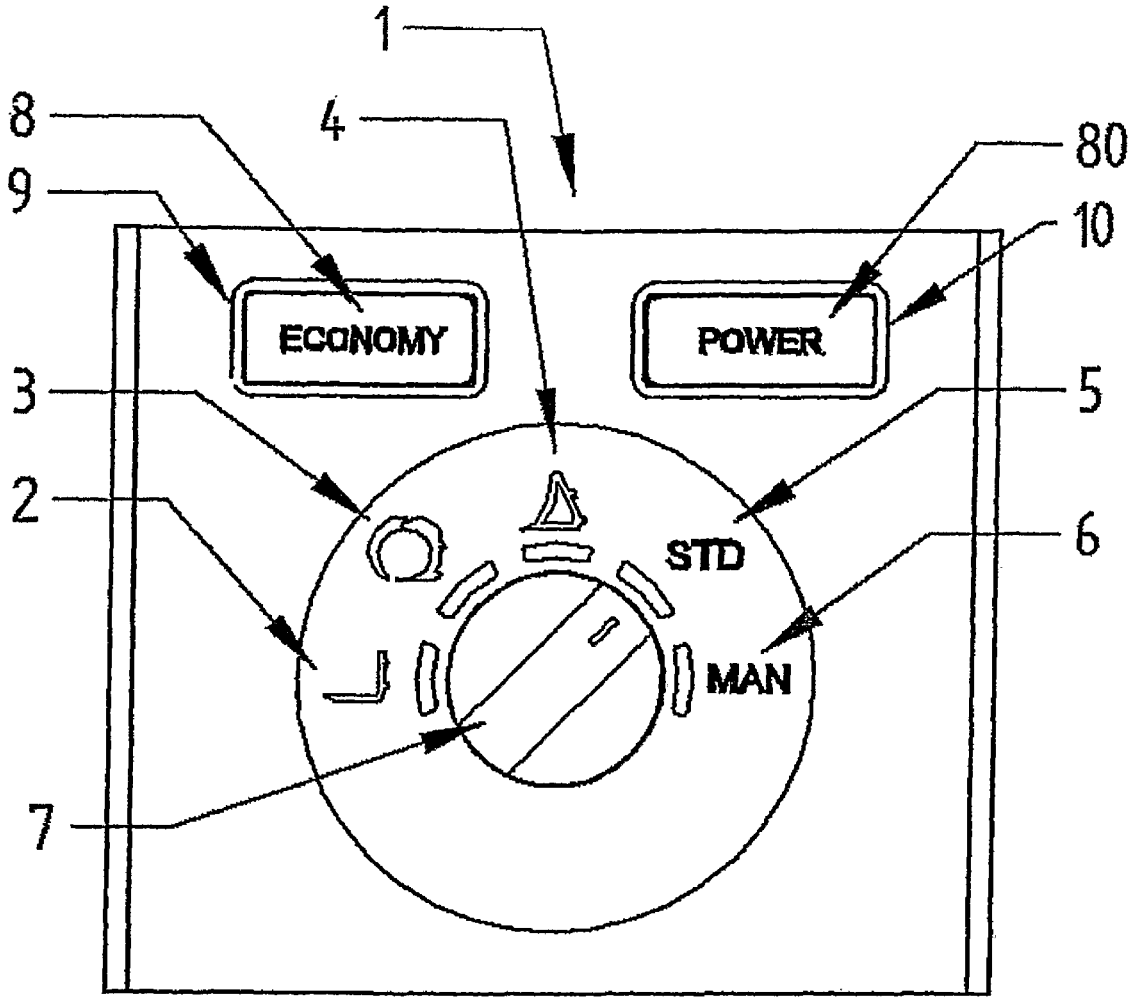
FIG. 1 is a diagram illustrating a preferred embodiment of a arrangement (means) configured to be actuated by an operator, and which can be set in several different positions.

FIG. 1 shows an actuation means 1 comprising a control 7 which can be set in several positions 2-6. The control 7 is of rotary design and is arranged at the instrument panel in the cab of a wheel loader and positioned for easy hand-operation by the driver of the vehicle. In the illustration, the various positions 2-6 define different operating states. Positions 2-4 relate to operating states in which different types of equipment (implements) are utilized for moving objects or materials. More precisely, position 2 illustratively represents a wheel loader that is provided with a fork implement, for example for pallet handling; position 3 represents the wheel loader being provided with a gripping arm unit, for example for lumber handling, and position 4 signifies the wheel loader being provided with a bucket, for example for handling gravel and stone.

The various implements (fork, gripping arms, bucket) are intended for different activities, and there are different requirements for speed and softness of movements, and the like, in order for the vehicle to function optimally with each of the possible attachments. Depending on which implement is utilized, it is possible, with the aid of the control 7, to set the vehicle so that the implement is handled in an optimum way. In other words, a number of operating parameters are controlled by the operating state selected. According to this embodiment, the movements of the machine and the maximum speed of movement of the implement are limited to different extents depending on the operating state selected.

Position 5 of the control 7 relates to an operating state referred to as "standard," and which corresponds to an operating parameter that can be used in most handling situations, but is not optimized for any specific handling type, or any specific implement. In this regard, the "standard" designation is therefore a type of universal mode suitable for such operator tasks as snow-plowing, sweeping and the like.

Position 6 of the control 7 relates to an operating state referred to as "manual," and which designates a state in which the driver, or other operating personnel, can personally set operating parameters for more individual implements and/or handling types in order for it to continue to be possible to utilize the wheel loader optimally for these applications. This mode allows the operator, for example, to set parameters for lifting, lowering, tilting-in and tilting-out.

The actuation means 1 (also referred to as actuation mechanism, selector and/or interface) also comprises elements 8, 80 for setting an economy mode 9 and, respectively, a performance or power mode 10 in all the operating states mentioned above. Here, the setting elements 8, 80 consist of two buttons, one for each mode. When the economy mode 9 is selected, the maximum speed of the engine is limited electronically to an optimum state for the handling, implement and machine type (handling type and the machine) with regard to economy. Transmission shifting points are also selected electronically for an optimum state for the handling type and the machine with regard to economy. When the power mode 10 is selected, the maximum speed of the engine is increased electronically to an optimum state for the handling type and the machine with regard to performance. Transmission shifting points are also selected electronically for an optimum state for the handling type and the machine with regard to performance.

This interface between person and machine constitutes a clear and intuitive way of controlling the machine in an optimum manner.

Figure 2:
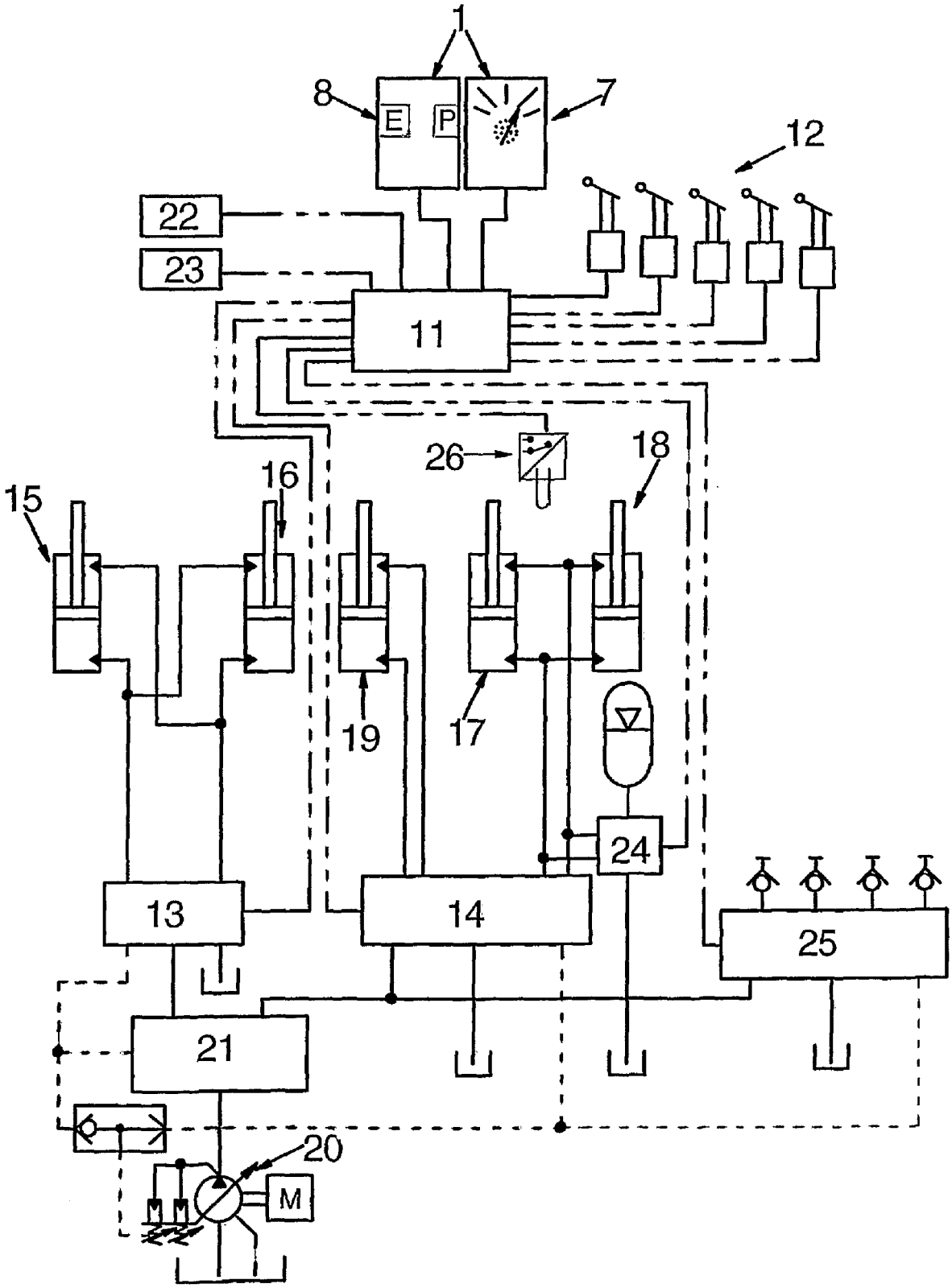
FIG. 2 is a schematic illustrating diagrammatically included components of an illustrative preferred embodiment of a device for controlling a machine configured according to the teachings of the present invention.

FIG. 2 illustrates an embodiment of a device for controlling a wheel loader. The solid lines indicate hydraulic lines, and the dashed lines indicate lines for electric signals. The device comprises a central unit 11, or computer, to which the actuation means 1 is connected. A number of electric operating levers 12 arranged in the cab are connected to the central unit 11, and this is adapted to handle the signals from the levers. A number of electrically controlled hydraulic valves 13, 14 are electrically connected to the central unit 11 and hydraulically connected to a number of working cylinders 15-19 for regulating the reciprocating work of these. A pump 20 is also provided in order to supply the working cylinders 15-19 with hydraulic oil via the hydraulic valves 13, 14.

The working cylinders 15, 16 consist of what are known as steering cylinders and are adapted to turn the wheel loader by means of relative movement of a front and a rear body part. The working cylinders 17, 18 consist of what are known as lifting cylinders and are arranged for lifting and lowering a lifting arm unit, on which the implement is mounted. The working cylinder 19 consists of what is known as a tilting cylinder and is arranged for tilting; that is to say, rotating the implement in the form of, for example, a bucket around a pin of the lifting arm unit. With the aid of the working cylinders 17-19, lifting, lowering, tilting-in and tilting-out movement is therefore obtained for the wheel loader. A prioritizing valve 21 is connected between the pump 20 and the electric valves 13, 14.

This valve 21 is adapted for prioritizing steering hydraulics over lifting hydraulics.

An accumulator 24 is connected to the loading cylinders 17, 18 in such a way that spring-action characteristics are obtained when the vehicle is driven with a loaded implement.

On the basis of the selected setting of the actuation means 1, the signals from the electric operating levers 12 are converted in a characteristic way in the central unit 11 and are then sent as output signals to the valves 13, 14 in the form of electric pilot hydraulic valves which in turn control the working cylinders 15-19. This signal conversion linked to the handling selected affords the driver optimized maneuverability for the handling selected.

According to an operating example, the machine is controlled in the following way in the various operating states (percentages indicate proportion of maximum capacity):

Pallet Handling State (Fork Implement):

Reduced lifting speed (suitably 70-85%, preferably 75-80%);

Reduced lowering speed (suitably 70-85%, preferably 75-80%);

Reduced tilting speed in (suitably 70-90%, preferably roughly 80%);

Reduced tilting speed out (suitably 70-80%, preferably roughly 75%); and

Loading arm spring action, determined by the setting of the accumulator 24, in state speed-dependent.

Lumber Handling State (Gripping Arm Unit):

Reduced lifting speed (suitably 70-90%, preferably roughly 80%);

Reduced lowering speed (suitably 70-90%, preferably roughly 80%);

Reduced tilting speed in (suitably 80-90%, preferably roughly 85%);

Reduced tilting speed out (suitably 70-85%, preferably 75-80%); and

Loading arm spring action, determined by the setting of the accumulator 24, in state speed-dependent.

Bucket Handling State:

Full lifting speed (100%);

High lowering speed (>95%);

High tilting speed in (>95%);

High tilting speed out (>90%); and

Loading arm spring action, determined by the setting of the accumulator 24, in state gear-dependent.

Standard State:

Normal lifting speed (suitably 80-90%, preferably roughly 85%);

Normal lowering speed (suitably 85-95%, preferably roughly 90%);

Normal tilting speed in (suitably 85-95%, preferably roughly 90%);

Normal tilting speed out (suitably 80-90%, preferably roughly 85%); and

Loading arm spring action, determined by the setting of the accumulator 24, in state selectable between gear-dependent and speed-dependent and also turned-off state.

Manual State:

Adjustable lifting speed (basic value roughly 85%; variable 50%-100%);

Adjustable lowering speed (basic value roughly 90%; variable 50%-100%);

Adjustable tilting speed in (basic value roughly 90%; variable 50%-100%);

Adjustable tilting speed out (basic value roughly 85%; variable 50%-100%); and

Loading arm spring action, determined by the setting of the accumulator 24, in state selectable between gear-dependent and speed-dependent and also turned-off state.

Another valve 25 is indicated in FIG. 2. This valve 25 is intended to regulate the supply of hydraulic oil to a hydraulic unit of an implement and is coupled hydraulically to the pump 20 via the prioritizing valve 21 and electrically to the central unit 11. The hydraulic unit of the implement can be comprised of, for example, a working cylinder of the gripping arms for moving these relative to one another or a working cylinder of the fork implement for relative movement of the two legs. The prioritizing valve is also adapted to prioritize the steering hydraulics over the hydraulics for the implement concerned.

FIG. 2 also illustrates the engine 22 and transmission 23 of the vehicle, and which are electrically coupled to the central unit 11. In addition to the signal from the control 1, the central unit 11 also handles the signal for economy or performance from the setting element 8 and interprets the maximum speed for the engine 22 and also the selected gear point (speed) for the transmission 23 on the basis of the state selected on the setting element 8 and the control 1.

The operating parameters which are determined by the operating state selected with the actuation means 1 are not limited to regulating the maximum speed of movement of the implement. According to one development, other specific characteristics of the machine are controlled in various ways depending on the operating state selected. These characteristics can be achieved by virtue of, for example, changing or selecting different algorithms in the gearbox of the machine for different operating states, or changing or selecting different torque curves in the engine.

The device also comprises means 26 for detection of the position of the implement, or of the loading arm unit.

This detection means consists of, for example, a sensor of conventional type. The detection means 26 is connected to the central unit 11. Different detected positions or areas within the movement pattern of the implement or of the loading arm unit correspond to different operating parameters, such as limitations, for example in the form of different maximum speed of movement. According to one illustrative embodiment, the implement consists of a bucket, and the maximum speed of movement is limited by a higher limit value when the bucket is located in a lower position in the vertical direction, that is to say close to the ground, and by a lower limit value when the bucket is located in a higher position in the vertical direction. This allows faster bucket movements in lower positions and slower bucket movements in higher positions. It is of course possible to envisage several alternatives or supplements to this illustrative embodiment, for example, with limitations of the speed of movement of the loading arm unit depending on where this is located in the lateral direction. It is of course also possible to use more than two different positions or areas.

According to the description above, the invention is implemented in a wheel loader. In this case, one of the implements is employed for a first use; for example, the bucket is used for loading gravel onto the platform of a truck. When it is desired to utilize the wheel loader for another use, such as loading logs, the bucket is replaced with the gripping arm unit. In other words, the bucket is released from its position on the loading arm unit, and the gripping arm unit is mounted in this position. With the aid of the control 7, the driver then changes over to the operating state concerned. The invention can of course also be implemented in cases where no exchange of implement is needed; that is to say, when two of the implements are intended simultaneously to be arranged in different positions on the construction vehicle. Such an example is found in a type of construction machine where the vehicle has a wheel loader unit arranged at the front and an excavating unit arranged at the rear; that is to say, in a configuration that is known as an excavator loader.

The invention is not to be considered as being limited to the illustrative embodiments described above, but a number of further variants and modifications are conceivable within the scope of the patent claims. For example, the hydraulic system described in FIG. 2 is to be regarded only as an example. The invention can also be implemented with separate hydraulic systems for steering and loading.

Within the scope of the invention, it is of course possible for the actuation means to be designed in a number of different ways. For example, the actuation means can comprise a set of one or more press-down buttons (push-buttons) which each correspond to a specific operating state. Alternatively, a linearly guided control (rheostat) can be used. As a further alternative, the actuation means can comprise a display on which it is possible to select the intended operating state. The actual selection operation on the display can be effected via a keyboard coupled to the display, or via touch buttons on the display or the like.

The actuation means is of course not limited to the handling types shown in FIG. 1, but more handling types are of course possible.

According to an alternative to the actuation means being arranged inside the cab of the machine, it can be arranged outside the machine. Furthermore, according to another variant, the actuation means is arranged in the vicinity of the area where the implement is intended to be attached to the machine. Each type of implement can be designed with a part characteristic of that type.

When the implement is mounted on the machine, this part acts on a correspondingly designed part on the machine, a signal being sent to the central unit and informing it of the type of implement which is mounted on the machine. The device can be designed so that the signal transmission between the implement and the machine is effected via signal lines or, alternatively, wirelessly with the aid of an electronic transmitter and receiver.

According to one development of the preceding alternative, a signal can be sent from a sensor which detects which implement is arranged on the machine, and the marking/position 2-4 which corresponds to this implement on the actuation means 1 can light up or be indicated in another way for the driver as a message about which implement is arranged on the machine and a recommendation about which operating state he can/should select.

According to an alternative to the embodiment described above, the actuation means can be settable in two different positions for the same type of implement.

These two positions then correspond to different work situations in which it is desirable for the machine to act in different ways.

Although the markings for the different positions 2-4 on the actuation means 1 according to the preferred embodiment indicate different implements (fork implement, gripping arms, bucket), each position relates to an operating state. Operating state means a handling type or an area of use, such as pallet handling, lumber handling, gravel/stone handling or sand handling. It is of course possible to use the same implement for different areas of use which require different operating parameters. For example, bucket handling can be employed for use in gravel quarries, for transporting sand, or in a mine. Likewise, different implements can be selected for the same type of area of use. According to an alternative, therefore, the individual handling types/tasks/areas of use can instead be illustrated in the various positions on the actuation means. The driver can therefore choose to set the control to an area of use which corresponds to the operating parameters according to which he wants the machine to function. According to an example, the driver can therefore use the bucket mode for pallet handling.

According to another alternative, it is possible to envisage the control unit 11 of the vehicle being programmed in order to analyze the driving during the handling selected and optimizing the control of the various operating parameters for this work. Examples of aspects which can be detected and analyzed by the control unit are how aggressively the driver drives, how much upward slope and downward slope he drives (for example number, length and inclination of the slopes), weight in the bucket (or not), stripping, ploughing, lighting on (or not), outside temperature and engine temperature. The control unit therefore analyzes the driving and changes the operating parameters in order to perform the work with a focus on, for example, fuel economy.

The handling type selected by the driver with the actuation means 1 therefore provides input data to the system which acts on hydraulics, engine and transmission. In the case of the transmission, the movement direction is not acted on, but remains unaffected. On the other hand, the gear stages, which are to be used, when they are to be activated and how they are engaged, are acted on.

Figure 3:
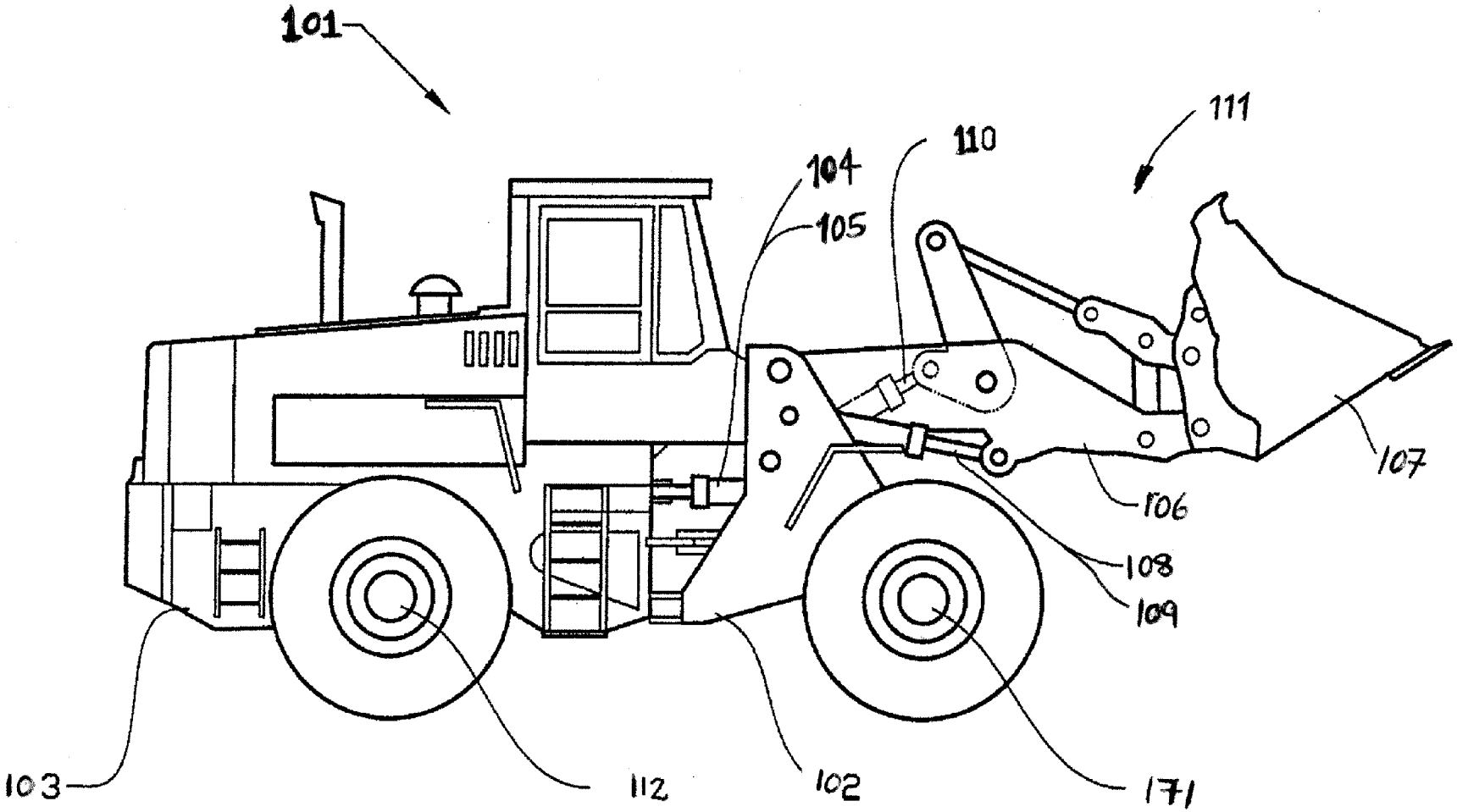
FIG. 3 is a side elevational view illustrating a wheel loader.

Referring to FIG. 3, a wheel loader 101 is illustrated. The body of the wheel loader 101 comprises a front body section 102 and a rear body section 103, and each section has a pair of half shafts 112,171. The body sections are connected to each other in such a way that they can pivot. The body sections 102, 103 can pivot in relation to each other around an axis by means of two first hydraulic components in the form of hydraulic cylinders 104, 105 arranged between the two sections. The hydraulic cylinders 104, 105 are thus arranged to turn the wheel loader 101.

The wheel loader 1 comprises an equipment or working tool arrangement 111 for handling objects or material. The arrangement 111 comprises a load-arm unit 106 and an implement 107, shown in the form of a bucket, fitted on the load-arm unit. The load-arm unit 106 can be raised and lowered relative to the front section 102 of the vehicle by means of two second hydraulic components that exemplarily take the form of two hydraulic cylinders 108, 109, and each of which is connected at one end to the front vehicle section 102 and at the other end to the load-arm unit 106. The bucket 107 can be tilted relative to the load-arm unit 106 by means of a third hydraulic component in the form of a hydraulic cylinder 110, which is connected at one end to the front vehicle section 102 and at the other end to the bucket 107 via a link-arm system.

Figure 4:
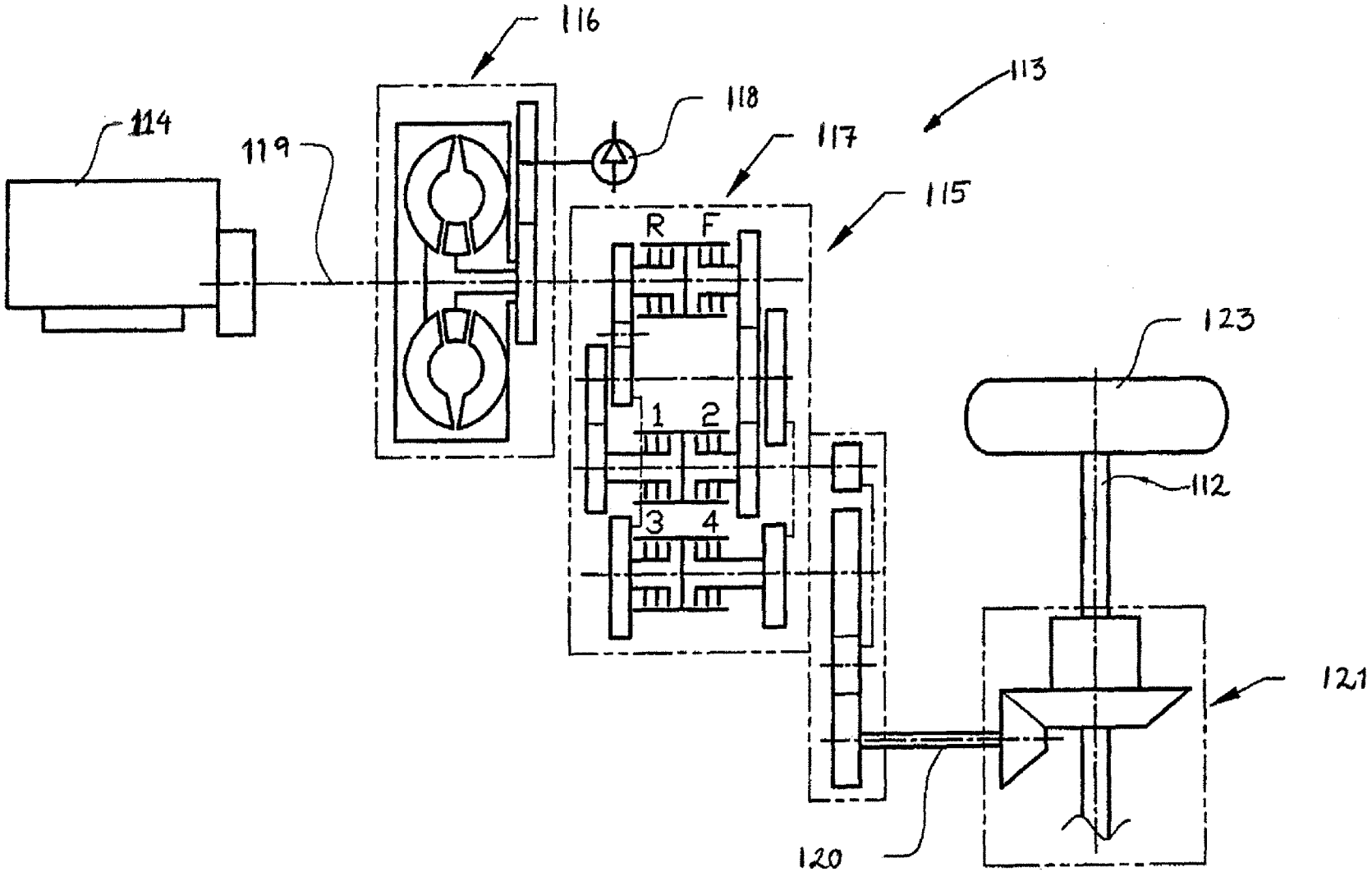
FIG. 4 is a schematic representation demonstrating an exemplary embodiment of a driveline for the wheel loader.

FIG. 4 schematically illustrates an example of a driveline 113 of the wheel loader's 101. In the illustrated example, the driveline 113 comprises a combustion engine 114, in the form of a diesel engine, an automatic gearbox 115 and a hydrodynamic torque converter 116. The gearbox 115 consists of an electrically controlled automatic gearbox of the power-shift type. The gearbox 115 comprises a forward and reverse gear 117.

FIG. 4 also shows a pump 118 in the wheel loader's hydraulic system for supplying the hydraulic cylinders 104, 105, 108, 109, 110 with hydraulic fluid. The pump 118 (like the torque converter 116) is driven by an output shaft 119 from the engine 114. An output shaft 120 from the gearbox 115 leads to a differential gear 121 that is drivingly connected to the half-shafts 112 on which the vehicle's driving wheels 123 are arranged.

Figure 5:
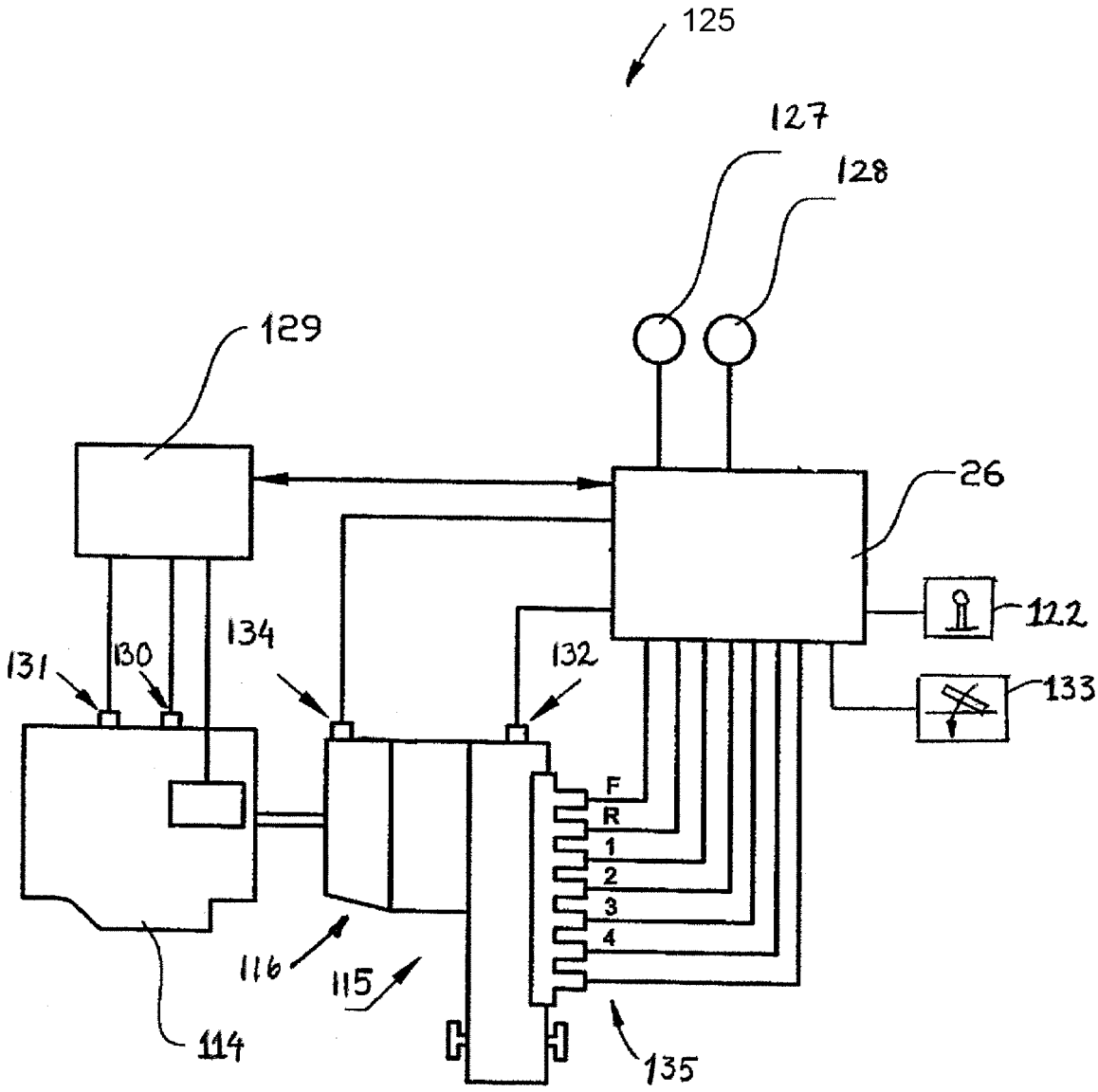
FIG. 5 is a schematic representation demonstrating a control device for controlling movements of the wheel loader.

FIG. 5 shows a device 125 for controlling movements of the wheel loader 101. The control device 125 comprises a first control unit 126 (or ECU, Electrical Control Unit) with software for controlling movements of the wheel loader. The control device 125 comprises means 127, 128 for determining a state of the equipment 111 for handling objects or material. The means 127, 128 are electrically connected to the control unit 126 and produce equipment state signals to the control unit 126.

More specifically, the means 127, 128 are arranged for determining a position of the equipment 111 and are preferably constituted by sensors. The means 127, 128 are arranged for detection of the position of the equipment in a vertical direction. The sensors 127, 128 are arranged for sensing the lift angle and the tilt angle, respectively, of the implement 107. The lift angle is defined in a vertical direction and determined by the extent of projection of the second hydraulic cylinders 108, 109. The tilt angle is determined by the extent of projection of the third hydraulic cylinder 110. The sensors 127, 128 are formed by angular sensors for sensing the angular position at an articulation point. Each of the sensors 127, 128 may alternatively be formed by linear sensors, sensing the extent of projection of the hydraulic cylinder in question.

The control device 125 comprises a second control unit 129, see FIG. 3, for controlling the speed of the engine 114, via control means 131. The second control unit 129 is functionally (electrically) connected to the first control unit 126 and obtains information from this concerning the desired engine speed. This desired engine speed is in turn controlled by the degree of depression of a gas pedal 133. A sensor detecting the depression of the gas pedal is coupled to the first control unit 126. The engine speed is thus increased with increased depression of the gas pedal.

The engine speed is detected via an engine speed sensor 130. The sensor 130 is electrically connected to the first control unit 126.

The vehicle's speed is detected by a sensor 132 in a conventional way, for example by measurement of the speed of rotation of a shaft inside the gearbox 115.

The control device 125 comprises means 134 for controlling the torque converter 116. The converter control means 134 is electrically connected to the control unit 126 and is controlled by the same. The converter control means 134 is here arranged for controlling lock-up of the torque converter 116.

The control device 125 comprises a plurality of means 135 for controlling transmission shifting points in the gearbox 115. The transmission control means 135 are electrically connected to the control unit 126 and are controlled by the same.

The control device 125 is arranged to shift gears according to a plurality of predefined gear modes. Shifting to a higher gear takes place at different minimum engine speeds in two different gear shifting modes. Further, shifting to a lower gear takes place at different minimum vehicle speed in two different gear shifting modes. One parameter for selecting the gear shifting mode is the above-mentioned determined equipment state. There may also be other parameters that influence the selection of gear shifting mode.

Further, a plurality of operating levers 122 are arranged in the wheel loader cab for being maneuvered by the driver and electrically connected to the control unit 126 for controlling movements of the wheel loader 101 (and the equipment 111). The signals from the operating levers 122 are converted in a characteristic way in the control unit 126 depending on the position signals from the position sensors 127, 128 and are then sent as output signals to the respective driveline component in question.

The inventive method for controlling the movements of the wheel loader will below be described according to a first embodiment in connection with FIGS. 6 and 7. The wheel loader 110 in FIG. 7 is equipped with a bucket 107.

Figure 6:
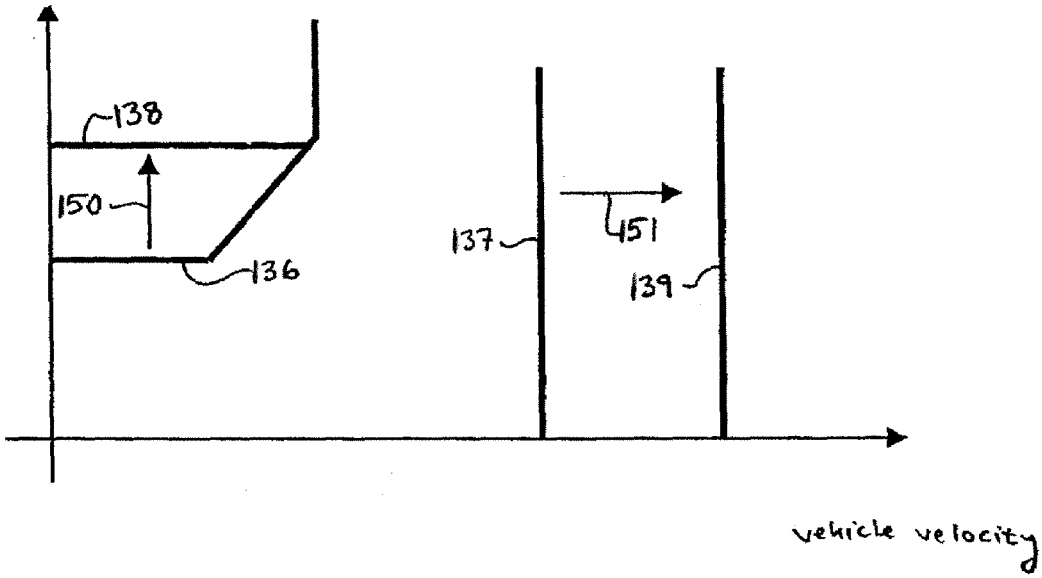
FIG. 6 is a diagram representing different transmission gear points.
Figure 7:
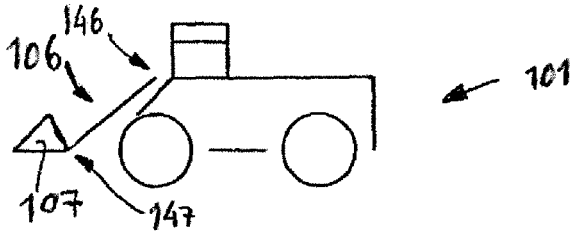
FIGS. 7-9 are schematic representations demonstrating a wheel loader in three different cases, wherein each of which demonstrate different equipment utilizations.

In FIG. 6, an example of a gear shifting procedure is shown for shifting between the first and second gear. Vehicle velocity is defined on the x-axis and engine speed is defined on the y-axis.

A state of the equipment 111 is defined by the lift angle and the tilt angle. More specifically, three position regions are defined for the lift angle, $\alpha$; "Bucket down": $\alpha<-30°$, "Bucket in between": $-30°<\alpha<30°$ and "Bucket raised":

$\alpha>30°$. Three position regions are also defined for the tilt angle, $\beta$; "Bucket forwards": $\beta<-30°$, "Bucket neutral": $-30°<\beta<30°$ and "Bucket backwards": $\beta>30°$. These three position regions for the lift angle and the tilt angle, respectively, give 3×3=9 equipment states.

Each of the nine equipment states correspond to a specific gear mode. Each gear mode comprises predefined transmission shifting points adapted for an optimum operation. Below follows three examples of gear modes.

A first curve 136, or line, in the diagram, defines the engine speed limit for shifting from gear number two to gear number one in a first gear mode. The gear shifting line is different for different gear modes, which is indicated by an arrow 150. A second curve 138, or line, in the diagram defines the engine speed limit for shifting from gear number two to gear number one in a second gear mode. The first and second curve 136, 138 are here defined by straight lines at different engine speeds.

A third curve 137, or line, in the diagram, defines the vehicle velocity limit for engaging lock-up in the converter 116 in a third gear mode. The converter lock-up line is different for different gear modes, which is indicated by an arrow 151. A fourth curve 139, or line, in the diagram defines the vehicle velocity limit for engaging lock-up in the converter 116 in a fourth gear mode. The third and fourth curve 137, 139 are here defined by straight lines at different vehicle velocities.

Hereinafter, a vehicle state is defined by the parameters engine speed and vehicle velocity. As a first example, the detected equipment state is: lift angle; "Bucket down", and tilt angle; "Bucket neutral". This equipment state is linked to the first curve 136 in the diagram (defining the engine speed limit for shifting from gear number two to gear number one). Further, this equipment state is also linked to the third curve 137 in the diagram (defining the vehicle velocity limit for engaging lock-up in the converter 116).

As a second example, the detected equipment state is: lift angle; "Bucket raised", and tilt angle; "Bucket forwards". For this equipment state, shifting down to gear number one is prohibited and lock-up in the converter is also prohibited.

As a third example, the detected equipment state is: lift angle; "Bucket down", and tilt angle; "Bucket backwards". This equipment state is linked to the second curve 138 in the diagram (defining the engine speed limit for shifting from gear number two to gear number one). Further, this equipment state is also linked to the fourth curve 139 in the diagram (defining the vehicle velocity limit for engaging lock-up in the converter 116).

As an alternative to the bucket, the above-described method is also applicable when the wheel loader is equipped with pallet forks, among the equipment accessory types. It should also be appreciated that the above-described method may also be used for equipment with more degrees of freedom.

FIG. 7 is a schematic drawing of the wheel loader shown in FIG. 3. The lift angle is indicated with reference numeral 146 at the position where the load-arm unit 106 is connected to the vehicle body. The tilt angle is indicated with reference numeral 147 at the position where the bucket 107 is connected to the load-arm unit 106.

Figure 8:
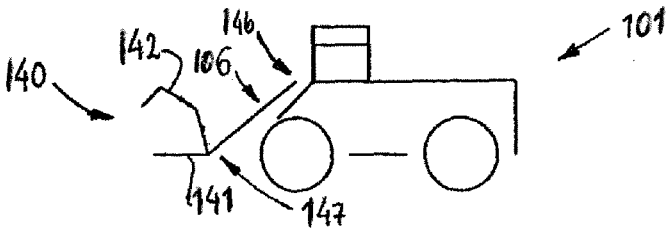

In FIG. 8, a wheel loader 101 is equipped with a timber enclosing fork 140. The lift angle is indicated with reference numeral 146 at the position where the load-arm unit 106 is connected to the vehicle body. The tilt angle is indicated with reference numeral 147 at the position where the fork 140 is connected to the load-arm unit 106. Such type of fork 140 comprises two arms 141, 142, which are movable in relation to each other via an articulation joint 147 for enclosing elongated pieces, like timber, between each other. The equipment state may in this case not only be defined by the plurality of equipment position regions for the lift angle and tilt angle, but in addition be defined by a plurality of equipment position regions for the relative positions of the two forks 141, 142.

Figure 9:
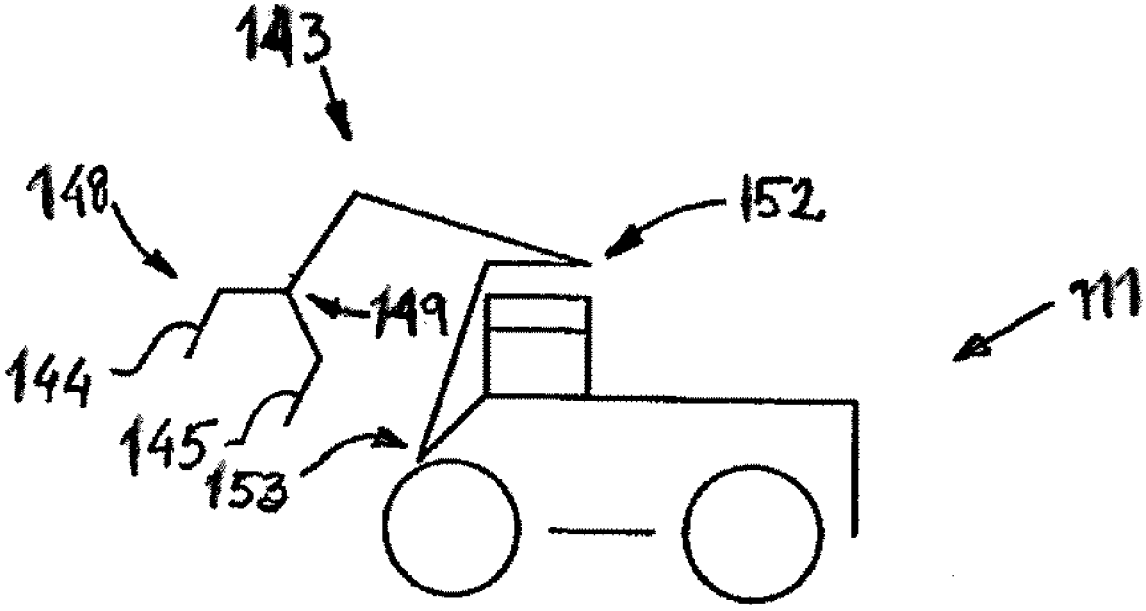

In FIG. 9, a wheel loader 101 is equipped with a specific type of load-arm unit; a so-called high lift 143 for timber. The tilt angle is indicated with reference numeral 153 at the position where the load-arm unit 143 is connected to the vehicle body. The lift angle is indicated with reference numeral 152 at an articulation point between two arms in the load-arm unit 106. Like in the embodiment of FIG. 8, the load-arm unit 143 comprises a fork 148. The fork 148 comprises two arms 144, 145, which are movable in relation to each other via an articulation joint 149 for enclosing elongated pieces, like timber, between each other. Further, the fork 148 is rotatably arranged in the load-arm unit at its point of connection to the load-arm unit 143. The equipment state may in this case not only be defined by the plurality of equipment position regions for the lift angle, tilt angle, and relative position of the two forks 144, 145, but in addition be defined by a plurality of equipment position regions for the rotation angle.

The invention is also directed to a computer program comprising code means for performing all the method steps described above when the program is run on a computer. The computer program is loaded in a memory in the control unit. The computer program may be sent to the control unit by wireless technique, for example via the internet.

The invention is further directed to a computer program product comprising program code means stored on a computer readable medium for performing the method described above when the program product is run on a computer. The computer readable medium may be in the form of a floppy disk or a CD-ROM.

The abovementioned control unit (ECU) 126 is also often called a CPU (Control Power Unit) or plainly vehicle computer.

For example, the gearbox design shown in FIG. 4 is only to be regarded as an example of a gearbox that can be used for carrying out the movement method. Further, the gear mode may comprise controlling the speed of the engine. In addition, the two control units 126, 129 can be integrated into a single control unit. As an alternative, or complement, to controlling transmission shifting points and lock-up in the converter, the control unit may be arranged to set a torque curve in the engine. As an alternative, or complement, to the vertical position, the equipment state may comprise the speed of movement of the equipment. The invention may also be applied for a fork-lift truck for handling pallets in an industry.

The invention is not in any way limited to the above described embodiments, instead a number of alternatives and modifications are possible without departing from the scope of the following claims.

What is claimed is:

1. A control system for a construction vehicle to which at least two different types of working implements are or can be attached either one-at-a-time by exchanging implements or simultaneously, the construction vehicle having a driveline that includes an engine and a transmission gearbox and the control system comprising:

an operator control device configured to be set to a plurality of operational control configurations, the operational control configurations each corresponding to a different realm of use of the construction vehicle, and a control unit, operationally connected to and responsive to the operator control device, for controlling operation of the engine in response to operator command inputs and a control unit, operationally connected to and responsive to the operator control device, for controlling operation of the transmission gearbox in response to operator command inputs;

wherein the maximum speed of the engine varies as a function of the operational control configuration to which the operator control device is set;

wherein transmission shifting points vary as a function of the operational control configuration to which the operator control device is set; and wherein a plurality of different working implements can be utilized within at least one of the realms of use of the construction vehicle.

2. The control system according to claim 1, wherein one of the working implements is attached to the construction vehicle and the manner in which the movements of the working implement are controlled in response to a given operator command input varies as a function of the operational control configuration to which the operator control device is set.

3. The control system according to claim 2, wherein a speed range for movement of the working implement attached to the construction vehicle varies as a function of the operational control configuration to which the operator control device is set.

4. The control system according to claim 1, wherein the speed of movement of the vehicle for a given operator command input varies as a function of the operational control configuration to which the operator control device is set.

5. The control system according to claim 4, wherein a torque curve of the engine varies as a function of the operational control configuration to which the operator control device is set.

6. The control system according to claim 1, wherein two realms of use of the construction vehicle correspond to operation with two different working implements.

7. The control system according to claim 1, wherein two realms of use of the construction vehicle correspond to operation with a given working implement for two different applications.

8. The control system according to claim 1, wherein said transmission shifting points are points that are based on engine speed.

9. The control system according to claim 1, wherein said transmission shifting points are points that are based on vehicle speed.

10. The control system according to claim 1, wherein the control unit for controlling operation of the engine and the control unit for controlling operation of the transmission gearbox are separate from each other.

11. The control system according to claim 1, wherein the control unit for controlling operation of the engine and the control unit for controlling operation of the transmission gearbox are integrated into a single control unit.

* * * * *